US006286980B1

(12) United States Patent
Meyer

(10) Patent No.: US 6,286,980 B1
(45) Date of Patent: Sep. 11, 2001

(54) RECESSED LIGHT PROTECTION COVER

(76) Inventor: Donald L. Meyer, 105 Alvin St., East Peoria, IL (US) 61611

( * ) Notice: Subject to any disclaimer, the term of this patent is extended or adjusted under 35 U.S.C. 154(b) by 0 days.

(21) Appl. No.: 09/342,085

(22) Filed: Jun. 29, 1999

(51) Int. Cl.[7] ..... F21V 21/00

(52) U.S. Cl. ..... 362/365; 362/373; 362/294; 362/364; 52/28

(58) Field of Search ..... 362/365, 373, 362/294, 364, 148; 52/232, 28, 221, 220.1, 742.1, 741.3

(56) References Cited

U.S. PATENT DOCUMENTS

| | | | | |
|---|---|---|---|---|
| 2,648,764 | | 8/1953 | Kirlin . | |
| 2,998,511 | | 8/1961 | Chan . | |
| 3,104,833 | | 9/1963 | Stuart . | |
| 3,112,891 | | 12/1963 | Cutler . | |
| 3,348,465 | | 10/1967 | Krugor . | |
| 3,846,072 | * | 11/1974 | Patterson | 362/373 |
| 4,237,671 | | 12/1980 | Munson . | |
| 4,375,142 | * | 3/1983 | McDonald | 52/28 |
| 4,400,766 | | 8/1983 | Munson . | |
| 4,675,225 | * | 6/1987 | Cutler | 52/3 |
| 4,754,377 | | 6/1988 | Wenman . | |
| 4,890,200 | * | 12/1989 | Mandy | 362/20 |
| 4,930,054 | | 5/1990 | Keibs . | |
| 5,548,497 | | 8/1996 | Cho . | |
| 5,915,828 | * | 6/1999 | Buckley | 362/294 |
| 6,079,856 | * | 6/2000 | Prestier | 362/365 |

* cited by examiner

*Primary Examiner*—Thomas M. Sember
(74) *Attorney, Agent, or Firm*—Amster, Rothstein & Ebenstein

(57) ABSTRACT

An insulation damming device formed from a moisture-proof and fire-retardant material for preventing the build up of thermal insulation around a recessed lighting fixture, fan or other heat producing device is installed in an attic. The device is formed from a vented cover member, a set of vented side panels and a set of mounting flaps. The vents are disposed at regular intervals along the side panels and cover to allow heat and moisture to escape from the enclosed area. Additionally, the vents can be covered with louvers to insure that no insulation enters the area enclosed by the insulation damming device.

2 Claims, 4 Drawing Sheets

RECESSED LIGHT PROTECTION COVER

TECHNICAL FIELD

This invention relates generally to insulation damming devices and specifically to a device which keeps insulation from coming into contact with heat-producing objects, fans, or the like.

BACKGROUND

Currently, there is a trend in construction, both in new construction and home improvements to heavily insulate attics to increase overall thermal efficiency of the structure. This insulation works year round; in winter the insulation prevents the warm air inside the living area from dissipating through the attic; and, during the summer, the cool air-conditioned air is not heated by the hot air in the attic. When a structure which has recessed lighting is being insulated, special care must be taken to prevent the insulation from coming in contact with the recessed lighting. Otherwise, the insulation will prevent heat dissipation from the lighting, thus causing the lighting unit to reach an elevated temperature causing a potential fire hazard. In fact, if insulation comes into direct contact with a heat source such as a light bulb, the insulation itself could combust.

One way in which this is accomplished is to take a standard batt of insulation and cut a shape in the batt corresponding to the recessed light, allowing a 2½" space around the lighting fixture. This process is both inefficient and time consuming. When cellulose or loose blown insulation is used, additional batts of insulation have to be purchased. These batts are then cut to surround the fixture. Finally, the cellulose or blown fiberglass insulation could be installed. However, great care is required to insure that the gap formed around the fixture is not filled with insulation during the insulation process.

Another style device which has been used as an insulation damming device is shown in U.S. Pat. No. 4,375,142. The damming device shown is comprised of a thin sheet of aluminum which is shaped to fit around the lighting fixture. Insulation is then placed around the damming device. Once again, there is no way to prevent insulation from entering the enclosed region inside the aluminum sheet and creating a fire hazard. Additionally, if insulation is desired at a depth greater than the dam, the insulation could easily fall within the cordoned off area.

SUMMARY OF THE INVENTION

The insulation dam disclosed herein solves these and other problems present in the prior art by creating an enclosed area which minimizes the risk of combustible insulation coming in contact with a recessed lighting fixture while still allowing heat and moisture to vent from within the enclosure. It is further an object of present invention to provide a novel damming device which is fire and water resistant. A feature of the present invention allows insulation to be built up around the lighting fixture while still providing a space between the recessed lighting fixture and the combustible insulation. It is further an object of the present invention to provide such a novel device which allows for fast, versatile, cost effective installation.

BRIEF DESCRIPTION OF THE DRAWINGS

These and other objects and features of the present invention will be best understood from following detailed description of the preferred embodiment of the present invention taken in conjunction with the drawings wherein.

DETAILED DESCRIPTION

When a new structure is being built or an existing structure is being renovated, many times, either recessed lighting fixtures are added or attics in structures that contain recessed lighting fixtures are reinsulated. In either of these situations it is desirable to have a sufficient quantity of insulation in the attic to prevent cool air-conditioned air during the summer from being heated by the warm air from the attic. Likewise, it is desirable to have a sufficient quantity of insulation in the attic during the winter months to prevent warm air from escaping into the attic. While it is desirable to use blown insulation, this cannot be done around lighting fixtures. There must be an air space surrounding the lighting fixtures to prevent the risk of fire. The insulation damming device disclosed herein allows blown in insulation to be used after the device is properly installed.

Figure 1:
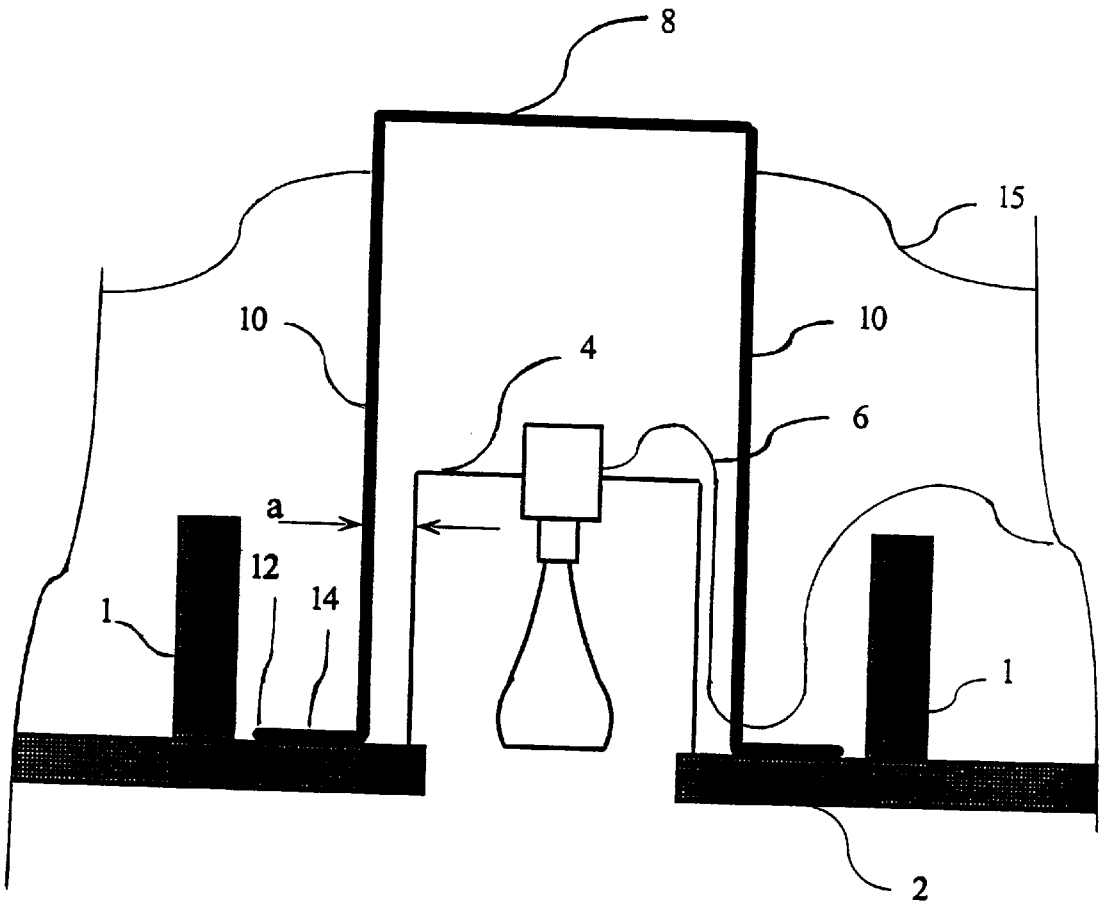
FIG. 1. is a cut-away view of the insulation damming device.

Referring to FIG. 1, there is shown a recess lighting fixture 4 mounted above the ceiling 2 of a structure. The lighting fixture 4 is mounted between a pair of ceiling joists 1. A cable 6 brings power to the recess lighting fixture 4. While this embodiment is being described using a recessed lighting fixture, the insulation dam described herein can also be used to prevent insulation from coming in contact with fans, air-conditioning compressors, or any other article which can be installed in an attic which should not come in direct contact with insulation.

As can be seen, the insulation damming device is comprised of a cover member 8, side members 10, and mounting flaps 12. The damming device is placed over lighting fixture 4 leaving gap "a" between the lighting fixture 4 and the insulation damming device. Typically this gap "a" is 2.5 inches. The insulation damming device is attached to the ceiling 2 by fastening mounting flaps 12 to the ceiling 2 utilizing fastener means 14. Fastener means 14 can take the form of nails, tacks, staples or the like. Additionally, the insulation damming device can be glued in place using a construction adhesive.

Once the insulation damming device is secured in place, insulation can be placed around the device. As show in FIG. 1, insulation 15 is built up around the device until the desired depth of insulation is reached. The insulation damming device is effective with any type of insulation, i.e. fiberglass batts, cellulose, or loose fiberglass. Due to the top member 8, insulation can actually be installed to a depth greater then that of the insulation damming device without the risk of insulation coming in contact with the recessed light 4.

Figure 2:
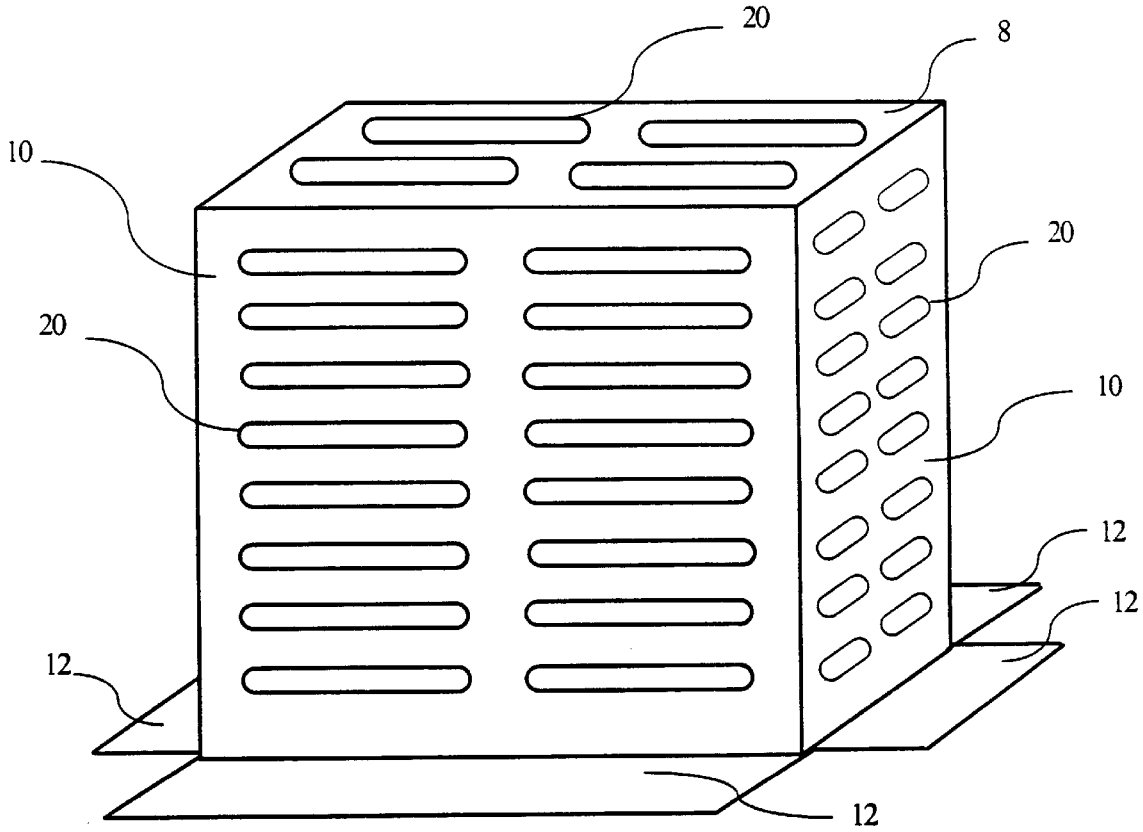
FIG. 2. is a perspective view of the insulation damming device.
Figure 3:
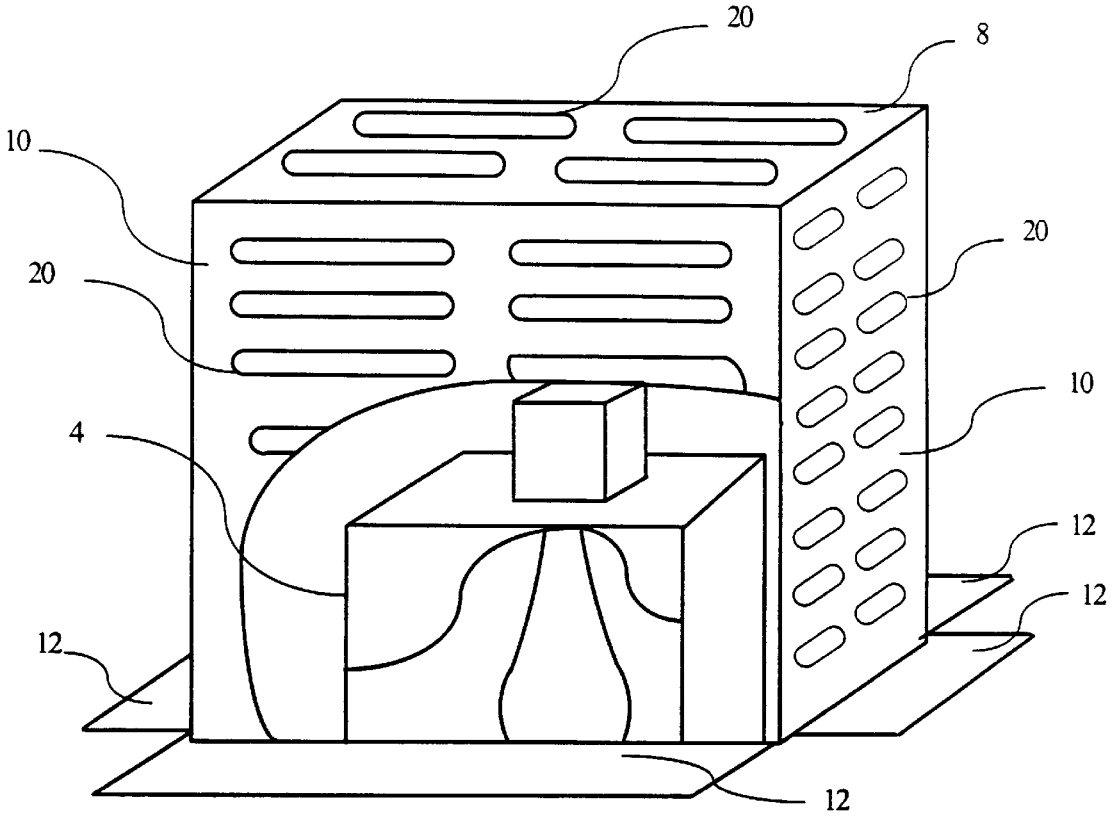
FIG. 3. is a perspective cut-away view of the insulation damming device.
Figure 4:
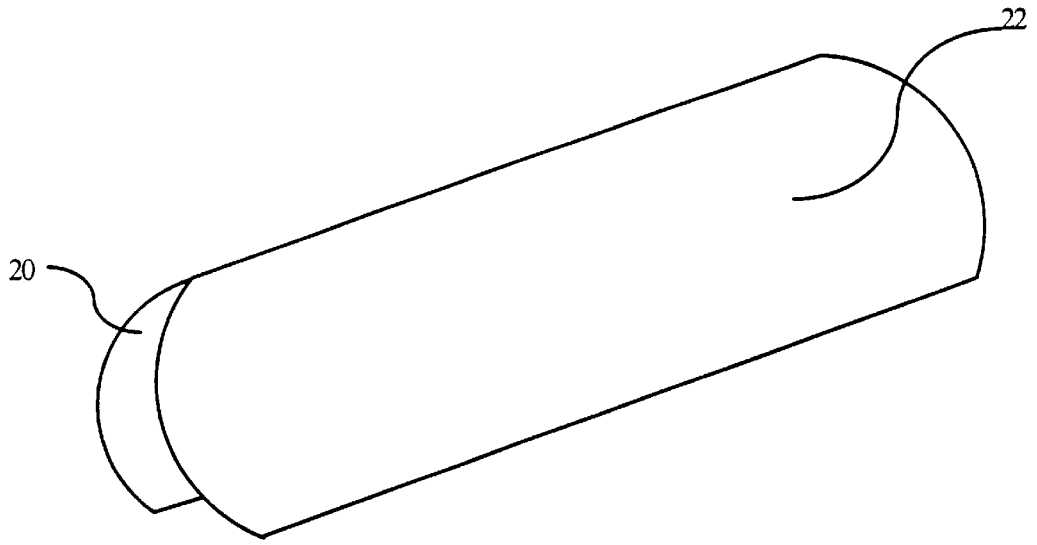
FIG. 4. is a view of the slot with a louver.

As shown in FIG. 2, the top member 8 and side panels 10 have slots evenly disposed thereon. The slots 20 allow heated air and moisture to escape from within the insulation damming device into the attic. Even after the insulation is installed around the damming device, the slots 20 in the top member 8 still allow hot air and moisture to escape, thus preventing dangerous heat build up within the insulation damming device. Each slot is approximately 4 inches long and $\frac{1}{8}^{th}$ of an inch wide. These dimensions allow heated air and moisture to escape while preventing insulation from entering the dam. Even blown in cellulose insulation or blown fiber glass insulation will not enter the damming device. Additionally, during the manufacturing of the insulation damming device the slots 20 may be partially punched out leaving a louver 22. The louvers 22, shown in FIG. 4 act as shields to further prevent insulation from entering the enclosed region defined by the insulation damming device while insuring the ventilation characteristics of the damming device.

Typically, the damming device is rectangular in shape. The top member 8 is a square approximately 12×12 inches. The side panels 10 are 12×16 inches. The 16 inch height allows for both a greater depth of insulation as well as the ability to clear most ceiling installed fixtures. The mounting flaps 12 are approximately 12 inches wide and extend approximately 1½ inches perpendicular to the side panels 10.

While the insulation damming device can be manufactured from a wide range of materials, the preferred materials are either a moisture and fire resistant corrugated cardboard or a foam panel with an aluminum backing which is also fire and moisture resistant. These materials provide sufficient durability to function as insulation damming devices. Also, the insulation damming device could be manufactured from sheet metal, tin, aluminum or the like. However, for a low cost insulation damming device the foam or cardboard should be the least expensive option.

Figure 5:
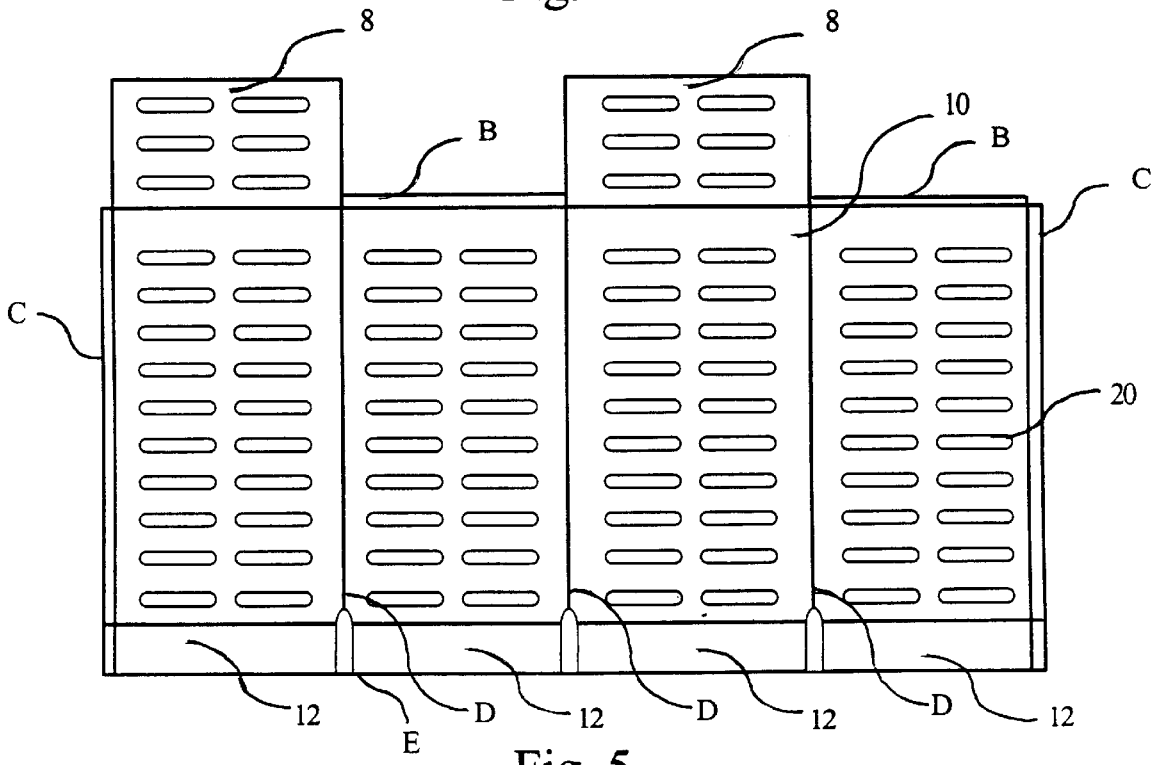
FIG. 5. is an unassembled view of the insulation damming device.

The insulation damming device can be provided assembled or unassembled. The damming device may be assembled in the attic immediately prior to installation or, if purchased preassembled only has to be installed. If the insulation damming device is purchased unassembled, it is easily assembled. FIG. 5 shows the insulation damming device prior to its being assembled. Assembly can be easily accomplished by the installer using glue, staples or duct tape.

The damming device is assembled by first folding the panels at folds D. The flaps C then align and overlap and can be glued, stapled or taped to form the damming device. The two halves of the top member 8 are then folded down and can be taped together where they meet. The two smaller flaps B are folded over the top members 8 to seal the edges of the top member 8 to prevent loose insulation from entering the enclosed area created by the damming device. The mounting flaps 12 are then bent perpendicular to the side panels 10 of the insulation damming device. Slots E serve a dual purpose, first they are used to form the mounting flaps 12, they also allow a space for the power cord 6 to exit the enclosed area. The assembled damming device is now ready to be installed over a recessed lighting fixture. The damming device is placed over the lighting fixture 4. The damming device is held in place by gluing, nailing or stapling the mounting flaps in place. Once the damming device is fastened in place insulation can then be installed around the damming device to the desired depth.

In an alternate embodiment the flaps B can be the same size as the top panels 8. In this situation the slots must be formed perpendicular to the slots on top panel 8 when the damming device is unassembled so that after assembly the slots will align. Here flap B is folded down first then top panels 8 are folded and secured in place. Only the top panels 8 will have louvers. This prevents top panels 8 from closing the louvers in flap B preventing the venting of the area enclosed by the damming device.

While the preferred embodiments of the invention have been disclosed herein, it is anticipated that variations to the disclosed embodiment can be made by persons skilled in the art without departing from the scope of the claims.

What is claimed is:

1. A device for damming insulation to prevent insulation from coming in contact with an object, comprising:

(A) a cover member having a plurality of edges;

(B) a plurality of side panels extending perpendicularly in a common given direction from each cover member edge and defining a respective free end;

(C) a mounting flap extending outwardly from each respective side panel free end;

(D) at least one vent disposed in the cover member to allow excess heat or moisture built up within the insulation damming device to escape; and (E) a louver partially covering said at least one vent to prevent insulation from entering the insulation damming device while insuring the ventilating characteristics of the insulation damming device.

2. A method for applying insulation in a structure which contains a heat-producing object comprising the steps of:

(A) placing over the object a damming device, the device being comprised of a cover member, a plurality of side panels extending perpendicular to and from the cover member, a plurality of mounting flaps disposed outward to and from the side panels, at least one vent in the cover member and a louver covering the at least one vent;

(B) attaching the mounting flaps to the structure;

(C) spraying insulation against the device; and (D) at least partially opening the louver prior to spraying insulation to prevent insulation from entering the device while insuring the ventilation characteristics of the device.

* * * * *